US005738616A

United States Patent [19]

Robertson

[11] Patent Number: 5,738,616

[45] Date of Patent: Apr. 14, 1998

[54] ROTATOR CUFF EXERCISE MACHINE

[76] Inventor: Richard C. Robertson, 515 N. Lyle, E. Wenatchee, Wash. 98802

[21] Appl. No.: 436,578

[22] Filed: May 8, 1995

[51] Int. Cl.[6] ..... A63B 23/12

[52] U.S. Cl. ..... 482/102; 482/134

[58] Field of Search ..... 482/72, 94, 98–99, 482/101–103, 130, 133, 134, 142, 20, 129, 139

[56] References Cited

U.S. PATENT DOCUMENTS

| | | | |
|---|---|---|---|
| 4,257,590 | 3/1981 | Sullivan et al. | 482/102 |
| 4,361,323 | 11/1982 | Segersten . | |
| 4,544,155 | 10/1985 | Wallenbrock et al. | 482/129 |
| 4,553,747 | 11/1985 | Pursley . | |
| 4,634,118 | 1/1987 | Jensen | 482/94 |
| 4,765,615 | 8/1988 | Case | 482/133 X |
| 4,775,146 | 10/1988 | Stankovic . | |
| 4,778,175 | 10/1988 | Wucherpfennig et al. . | |
| 4,919,418 | 4/1990 | Miller . | |
| 4,957,281 | 9/1990 | Christolear, Jr. . | |
| 4,966,363 | 10/1990 | van der Hoeven | 482/134 X |
| 4,988,098 | 1/1991 | Miller . | |
| 5,037,090 | 8/1991 | Fitzpatrick . | |
| 5,085,429 | 2/1992 | van der Hoeven | 482/130 |
| 5,147,263 | 9/1992 | Mueller . | |
| 5,158,517 | 10/1992 | Steggert | 462/20 X |
| 5,304,107 | 4/1994 | Jones | 428/134 X |
| 5,316,528 | 5/1994 | Ziparo | 482/142 X |
| 5,336,142 | 8/1994 | Dalebout et al. . | |

FOREIGN PATENT DOCUMENTS 2147513 5/1985 United Kingdom .

OTHER PUBLICATIONS

Schwarzeneggar, A. and W. Dobbins. 1985. *Encyclopedia of Modern Bodybuilding*. NY: Simon R. Schoster.

*Primary Examiner*—Stephen R. Crow
*Assistant Examiner*—John Mulcahy
*Attorney, Agent, or Firm*—Davis, Graham & Stubbs LLP

[57] ABSTRACT

A rotator cuff exercise machine has a frame, a body support member spaced from the frame such that the user sits facing the frame, a weight resistance, a pulley system mounted 15° to 45° off center to the left side of the frame, a pulley system mounted 15° to 45° off center to the right side of the frame and a pair of wrist cuffs. The user reaches diagonally downward across his or her body to the lower opposite side of the machine and either grasps a handle or attaches the wrist cuff to cable end means of the pulley system. The user then exercises in a manner which imitates the motion of an athlete throwing a ball, changing the weight resistance as desired.

3 Claims, 7 Drawing Sheets

ROTATOR CUFF EXERCISE MACHINE

This invention relates to exercise machines, and more specifically, to an exercise machine useful in rehabilitating shoulder injuries and strengthening the muscles of the rotator cuff.

BACKGROUND OF THE INVENTION

Shoulder injury is very common in athletic activity, and especially in activities involving the throwing motion. The repetitious movement of the throwing motion during maximal effort applies a great amount of stress on the four specific rotator cuff muscles involved during the deceleration of the arm. The rotator cuff or musculotendinous cuff consists of the fibers of the supraspinatus, infra-spinatus, terses minor and subcapularis muscles, which blend with and reinforce the capsule of the shoulder joint. It is of particular importance to athletes to keep these muscles strong because although the degeneration and subsequent tearing of these muscles is a rather common pathology, the result is restriction of shoulder movement.

There are many machines useful for exercising and strengthening the muscles of the rotator cuff, as indicated by the prior art. For example, U.S. Pat. No. 4,988,098 of Miller discloses a rotator cuff exercise machine which includes an upright support frame having a front, a top, a first and second sides defining a plane of the upright support frame and a support structure extending from the front adjacent top of the upright support frame. The machine includes a forearm support assembly for supporting a forearm of the user in a plane substantially transverse to the plane of the upright support frame, wherein the transverse plane also passes through the shoulders of the user such that the user's arm is positioned substantially in the transverse plane to isolate the user's rotator cuff. A tension mechanism is mounted on the upright support frame and includes a tensioned cable. A cam mechanism is connected to the tensioned cable and supported by the structure of the upright support frame for rotation with the forearm support assembly under tension as the user's forearm is rotated.

U.S. Pat. No. 4,957,281 of Christolear, Jr. teaches a rotator cuff therapeutic apparatus which includes a stack of weights supported on a frame for vertical movement from a rest position and an actuator mechanism on the frame adapted to be gripped and rotated by a hand of a user to move the weights along the working stroke. The actuator mechanism is positionable for permitting a corresponding rotational working motion of one of the user's arms as the user grips the actuator mechanism. For transmitting the rotational motion of the user's arm to move the weights, a ratchet-type mechanism is provided which is connected to the actuator mechanism to allow internal and external rotation of the arm. A two piece cam assembly with replaceable cams is provided and is connected between the weights and the ratchet mechanism for permitting progressive resistance.

U.S. Pat. No. 4,553,747 of Pursley discloses a rotator cuff machine comprising an upright support frame having a front, back, and two sides. A handle is connected to a tensioning structure mounted on the upright support frame. The tensioning structure sets the handle such that the handle can be moved forward of the support frame under tension. A first body support member is spaced from the upright support frame and contains a first support surface positioned in front of the upright support frame. A second body support member is spaced from the upright support frame and contains a second support surface positioned in front of the upright support frame. The second support surface is spaced laterally of the first support surface and is also spaced vertically above the first support surface such that the arm of a user can rest substantially horizontally on the second body support surface while the user sits on the first body surface.

U.S. Pat. No. 4,775,146 of Stankovic teaches a multipurpose physical fitness apparatus. The fitness machine of this invention has two generally rectangular frames standing upright in laterally-spaced-apart relation to define the narrow ends of a rectangular floor area for usually one but possibly three exercising persons. Each frame contains a stack of weights which are constrained to move vertically only, and there is a pulley and cable system for an exerciser to lift the weights. A third rectangular frame stands upright on a laterally and vertically extending plane that is coincident with the long rear side of the rectangular area. The third frame is fixed midway between the two end frames and these frames have stacks of weights and pulley and cable systems for an exerciser to lift the weights. Structural members tie all three frames together at their upper ends.

Although not indicated by the patents just discussed, it is generally known that athletes have sometimes exercised the rotator cuff by simply using a flexible cord attached to a fence or a wall on one end and attached, for example, to a ball on the other end. The user exercises by grasping the ball while facing the wall and pulling the ball on the cord away from the wall to an arm position above the head and then following through with a throwing motion that returns the extended arm back towards the wall.

Also known in the prior art is the use of computerized devices to control the resistive forces exerted by exercise machines. For example, U.S. Pat. No. 4,778,175 of Wucherpfennig et al. teaches an electronic controller for exercise machines having electronically actuated brakes as the resistance force for the exercise. The accuracy of the system in terms of actual resistance force delivered by the machine compared with the user selected value is improved through techniques for compensating for hysteresis effects in the brakes. When changing the output of the brakes on each half cycle of the exercise in accordance with user selected values, the system compensates for hysteresis effects in the brake in responding to increased current, decreased current, or steady state current conditions. The user can set soft limits for a particular range of motion of the exercise apparatus. The limits are in the form of an audible beep and are set as the system learns the desired range of motion from the user on a first cycle through the exercise.

Likewise, U.S. Pat. No. 4,919,418 of Miller discloses a computerized drive mechanism for exercise, physical therapy and rehabilitation. The equipment has a reciprocating extendible and retractable tension transmitting device which is equipped with a control that restricts the extension to a constant velocity and imposes a compulsory constant velocity retraction. The control may be hydraulic or electrical, and may include a linear actuator. Transducers or a load cell connected to the apparatus produce signals representing the performance of the user. These signals are processed by a control computer which produces control signals.

Although machines and exercise apparatus found in the prior art have made certain advances in the manner in which an athlete's rotator cuff is exercised and strengthened, the limitations encountered can readily be seen. For example, some machines restrict the motion of the arm, therefore not specifically mimicking the motion of an athlete using the throwing motion. Others, while allowing for a free flowing motion, do not operate on principles of specificity and do not apply increasing or known weight resistance. Machines found in the prior art that exercise the rotator cuff often do not effectively stabilize the upper body. Additionally, machines found in the prior art that have a handle grasped by the hand result in an exercise resistance that is dependant on the grip strength, or on the wrist strength of the user. A machine desirable for the strengthening of the rotator cuff would free the elbow of the user, while stabilizing the upper body. The machine would apply the principle of specificity by imitating the throwing motion, and applying resistance directly onto the muscles of the rotator cuff.

SUMMARY OF THE INVENTION

The present invention provides an exercise machine for strengthening the muscles of the rotator cuff. It is the object of the invention to provide an exercise machine for the rotator cuff that, while using a graduated weight resistance, frees the user's elbow during the exercise, which effectively mimics the movement of an athlete's follow through after the maximal throwing motion.

It is another object of the invention to provide a machine for exercising the muscles of the rotator cuff by placing the exercise resistance directly on the muscles of the rotator cuff rather than relying on the wrist or grip strength of the user.

Another object of the present invention is to provide a variable pulley system to exercise between 15° and 45° off center to accommodate the different follow through of the user.

Yet another object of the invention is to provide a rotator cuff exercise machine that stabilizes the upper body of the user while the user is exercising to provide an isolation of the muscles of the rotator cuff according to the present invention.

These objects are achieved by the rotator cuff exercise machine according to the present invention. In a preferred embodiment of the invention, the machine includes a vertical support frame which holds a weight stack and pulley system. The vertical support frame is attached to a horizontal lower frame which stabilizes the vertical support frame, and a body support assembly, including a seat, is attached to the horizontal lower frame, allowing the user to sit, facing the vertical support frame. The user achieves upper body support by adjusting both a chest and back restraint located in the front and rear of the seat respectively.

To the right and left side of the vertical support frame are located a pair of identical pulley and cable systems which allow for exercising either the right or left side rotator cuff with little to no machine adjustment.

The pulley and cable systems begin with cable endpoints located at the lower right and left sides of the vertical support frame. A cable runs to the top of the vertical support frame, to the center of the vertical support frame, and down to a stack of weights. Alternatively, the stack of weights may be replaced with a computer generated resistances, capable of applying a graduated series of resistance as the user performs the throwing motion.

In practice, the user sits on a seat facing the vertical support frame, adjusting the height of the seat along with the chest and back restraints for maximum comfort and stability without hindering their arm range of motion. Next, the user selects pulley degrees from 15° to 45° off center that mimic his or her follow through. The user selects a desired weight resistance from the stack of weights, or by programming a value into a computer. The user may grasp a handle with their non-exercising arm. The user then reaches across the machine downward, until his or her arm is extended out in front and grasps a handle at the endpoint of a cable running through the machine to the weights. Next, the user pulls back until their arm is back and above his or her head. Finally, the user moves his or her arm forward from above the head until the arm is extended out in front of the body. Optionally, the user may wear a wrist wrap that includes a ring, allowing the wrist wrap to be attached to a clamp at the endpoint of the pulley and cable system. This eliminates the potential for the user to counter the resistance of the weight by the strength in his or her wrist or grip, and instead, places the resistance directly on the muscles of the rotator cuff.

DETAILED DESCRIPTION OF THE PREFERRED EMBODIMENTS

Figure 1:
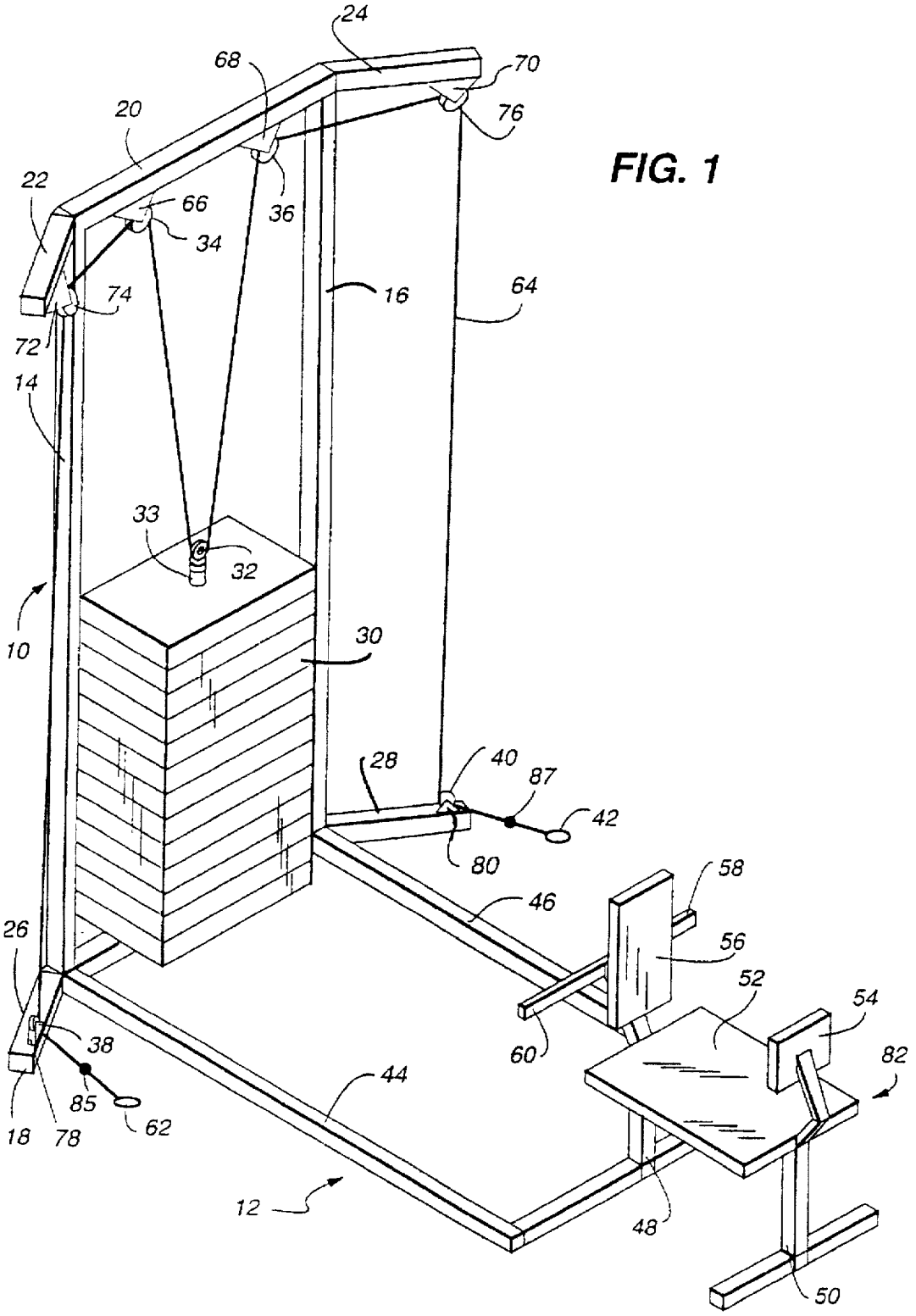
FIG. 1 is a perspective view of the exercise machine of the present invention.

With reference to FIG. 1, it can be seen that the rotator cuff exercise machine of the invention includes a vertical support frame 10 which is attached to a horizontal lower frame 12.

Vertical support frame 10 stands upright on the surface of a floor and is comprised of two parallel transversely spaced apart upright columns marked 14 and 16. Columns 14 and 16 stand upright on base plate member 18 that can be bolted to the floor by anchor bolts set into the floor, which are not shown. The upper ends of frame columns 14 and 16 are connected together by transversely extending cross member 20.

Extending diagonally outward from each end of cross member 20 are two upper guide rods, 22 and 24. Guide rods 22 and 24 angle outward from cross member 20 in the direction of the horizontal lower frame 12 at angles of approximately thirty degrees.

Parallel to the upper guide rods 22 and 24, and extending diagonally outward from base plate member 18 are a pair of lower guide rods 26 and 28. Lower guide rods 26 and 28 are positioned to extend diagonally outward at angles identical to those at which upper guide rods 22 and 24 are positioned.

Upper guide rods 22 and 24 along with lower guide rods 26 and 28 function together to form the framing structure for a pulley and cable system on both the right and left side of the vertical support free. Upper support rod 24 and lower support rod 28 form the framing structure for the right side pulley and cable system, while upper support rod 22 and lower support rod 26 form the framing structure for left side pulley and cable system.

Both right and left side pulley and cable systems begin at a stack of weight plates 30. These plates are arranged in a stack whereby each plate weighs five pounds, allowing for loading a weight resistance for exercising in five pound increments. Weights 30 have vertically aligned holes so that they may slide along guide rods [not shown]. One or all of the weights may be used in an exercise routine. Selection of the number of weights to be lifted by the exerciser is made by putting a pin through a laterally extending hole through the weight and into a carrier bar 33 such that all weights above the hole are lifted when the carrier bar is lifted and the weights below the pin remain at rest in the frame.

It is readily understood by those skilled in the art that weight stack 30 may be replaced by a computer generated resistance, in a manner that will subsequently be described.

As can be seen with reference to FIG. 1, both the right side pulley and cable system and the left side pulley and cable system begin at central pulley 32, which is located at the top of weights 30. Two pulley brackets, 66 and 68 are mounted just off center on the underside of cross member 20. Pulleys 34 and 36 are supported for rotation by pulley brackets 66 and 68.

Mounted in the center and near the end of guide rods 22 and 24 are a second set of pulley brackets, 70 and 72 which support pulleys 74 and 76 for rotation. Similarly, mounted in the center near the end of lower guide rods 26 and 28 are a third set of pulley brackets, 78 and 80 which support pulleys 38 and 40. A single cable 64 runs along the pulleys in the machine of this invention.

Cable 64 starts at endpoint 42, near the lower right hand side of the machine where a handle or clasp is located. Cable 64 runs around pulley 40 and upward to the top right hand side of the machine over pulley 76. Cable 64 then extends inward to the top center of the machine to pulley 36. At pulley 36, cable 64 extends downward to pulley 32 which is engaged, by way of carrier bar 33, with the stack of weights 30.

Cable 64 encircles pulley 32 and then extends upwards to pulley 34, located near the top center of the machine of this invention. Cable 64 then extends outward to the upper left hand side of the machine where it encircles pulley 74. From pulley 74, cable 64 extends downward to pulley 38 and then out to endpoint 62, where a handle or clasp is located.

A cable stop 85 is located on cable 64, between pulley 38 and endpoint 62 to prevent the cable endpoint 62 from being drawn through the pulley and cable system and to allow weight stack 30 to rise as the cable is pulled from the opposite endpoint 42. Cable stop 85 is positioned on cable 64 about 1½ feet out from pulley 38 and consists of a polyurethane ball having a diameter of approximately 1½ inches. In a similar fashion, cable stop 87 is positioned on the other end, between pulley 40 and endpoint 42.

It is readily understood that by a user's exerting force on either the right side (from end point 42) or the left side (from end point 62) of the pulley and cable configuration of the exercise machine, weight stack 30 may be lifted.

Still with reference to FIG. 1, it can be seen that extending outward from baseplate member 18 is a horizontal lower frame 12 comprised of a pair of parallel support rods 44 and 46. At the proximal end, parallel support rods 44 and 46 are bolted to base plate member 18. At the distal end, support rods 44 and 46 are attached to a body support assembly indicated generally by reference character 82.

Body support assembly 82 is comprised of a seat 52, back restraint 54, front restraint 56, and handles 58 and 60. The height of seat 52 is adjustable by engaging a pin into a hole setting located along vertical body support uprights 48 and 50. Similarly, although not pictured but readily understood, back restraint 54 and front restraint 56 are adjustable both horizontally and vertically to accommodate users of various sizes.

Figure 2:
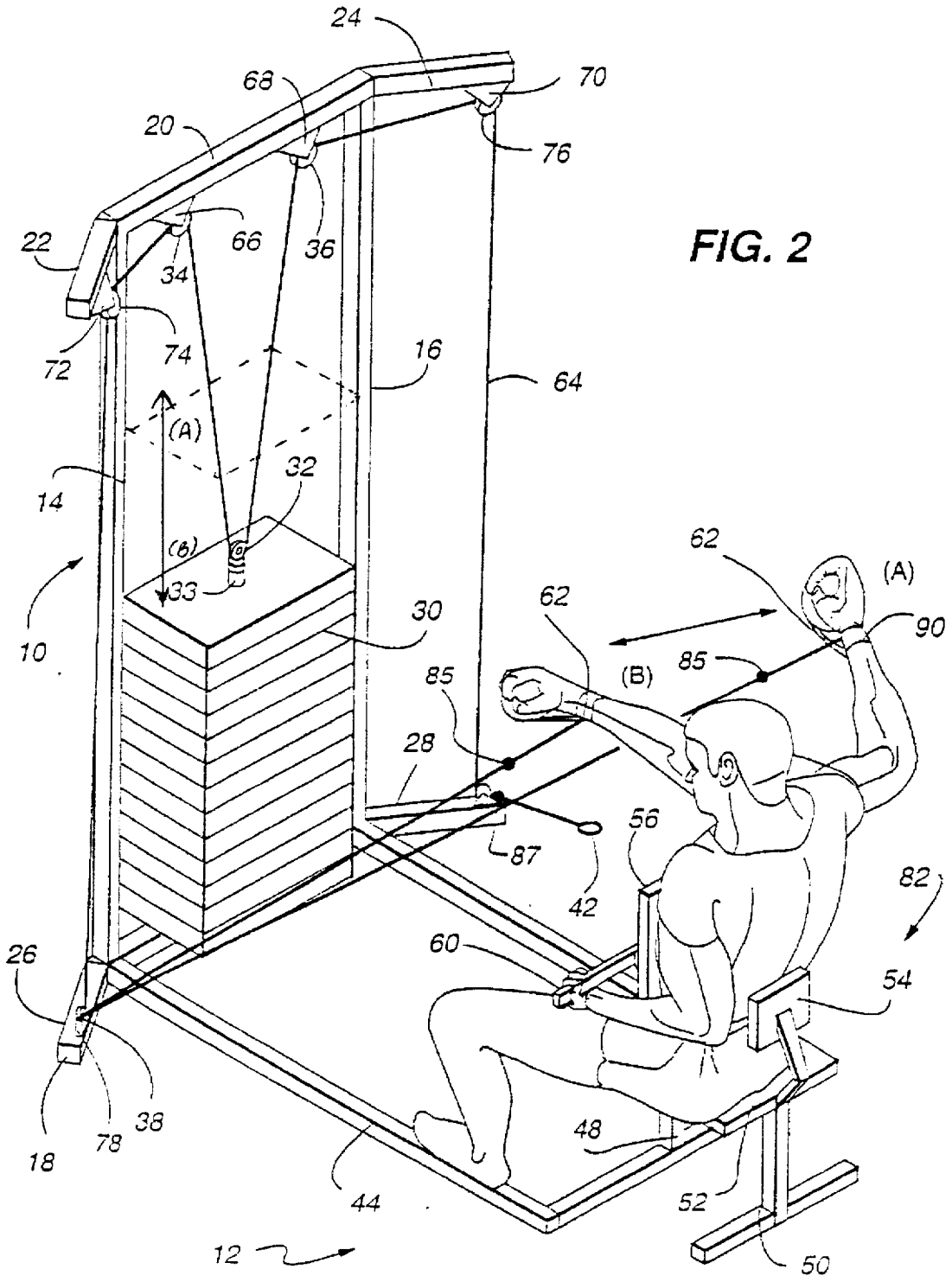
FIG. 2 is the perspective view of FIG. 1, showing a person using the exercise machine.

In practice, as best seen with reference to FIG. 2, the rotator cuff exercise machine of this invention is used generally as follows. A user sits on seat 52 facing the vertical support frame 10 of the machine of this invention, adjusting the height of the seat until his or her knees are bent at an angle of 90 degrees to the floor. The user adjusts back restraint 54 and front restraint 56 to a position of maximum comfort and upper body stability. The user places his or her non-exercising arm onto either handle 58 or 60. The user then presets the desired weight resistance for exercise by setting a pin into weights 30, making his or her selection from a set of weights with 5 pound increments. As will subsequently be discussed, weights 30 may readily be replaced by computer controlled weight resistance, allowing the user to preset the resistance using a digital computer display.

The user, now ready to exercise, reaches diagonally downward with the arm that will be exercised across the front of the seat to the opposite side of the machine. As an example, if a user wished to exercise his or her right side rotator cuff, he or she would grasp handle 60 with his or her left hand, and reach with his or her right hand to cable endpoint 62. The user would grasp handle 62, pulling the cable across their body in a manner that imitates the reverse follow through of a throwing motion approximately to position (A). The pulley system of the machine is set up so that the throwing arm is being trained for 15 degrees to 45 degrees off center on the opposite side of the body. The user then moves his or her arm from its position back above the head until it is extended outwardly in front of the body, approximately to position (B), in a motion that imitates the forward release and follow through of a throw.

Optionally, but in accordance with a preferred embodiment of the invention, the user of the rotator cuff exercise machine can use a wrist wrap worn on the wrist of the arm they seek to exercise. Wrist wrap 90 can be generally seen with reference to FIGS. 3–5.

Figure 3:
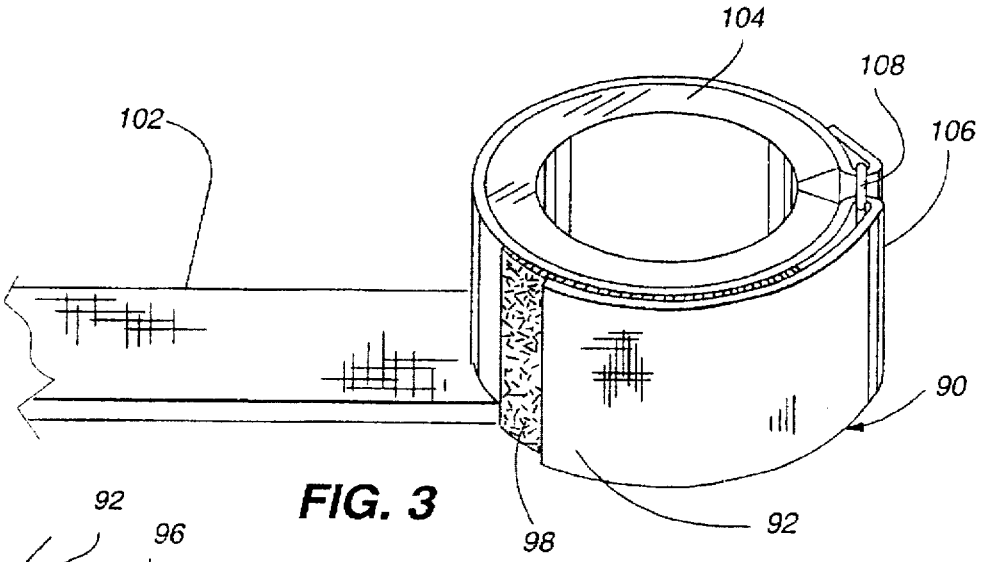
FIG. 3 is a perspective view of the wrist wrap of the present invention.

With reference to FIGS. 1 and 3 it can be seen that when wrist wrap 90 is worn, a clasp located at either endpoint of cable 64 may be attached to metal half moon shaped ring (100 with reference to FIG. 4, not separately shown or numbered in FIG. 1 or FIG. 3) located on the underside of wrist wrap 90. Use of the wrist wrap 90 ensures that during exercise, pressure is applied on the distal end of the radius and ulna-bones of the lower arm. The placement of the wrist wrap 90 is designed to place resistance directly onto the muscles of the rotator cuff during the eccentric phase of the exercise. The exercise resistance is no longer dependent on the grip strength of the user or the strength of the user's wrist.

Figure 4:
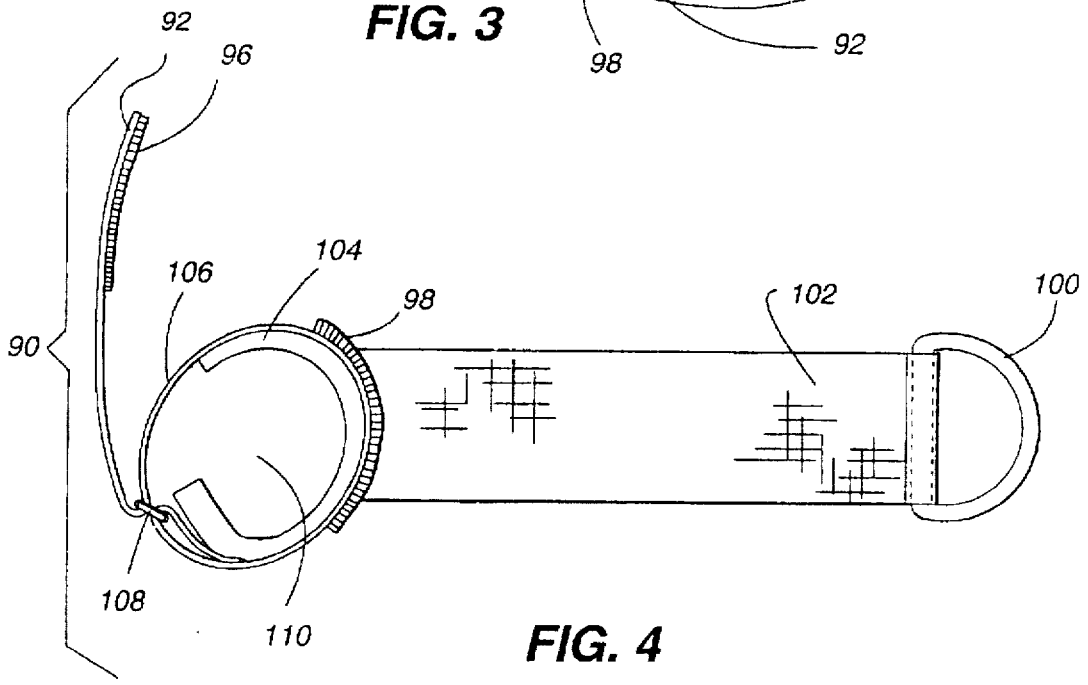
FIG. 4 is a side elevation view of the wrist wrap of the present invention.
Figure 5:
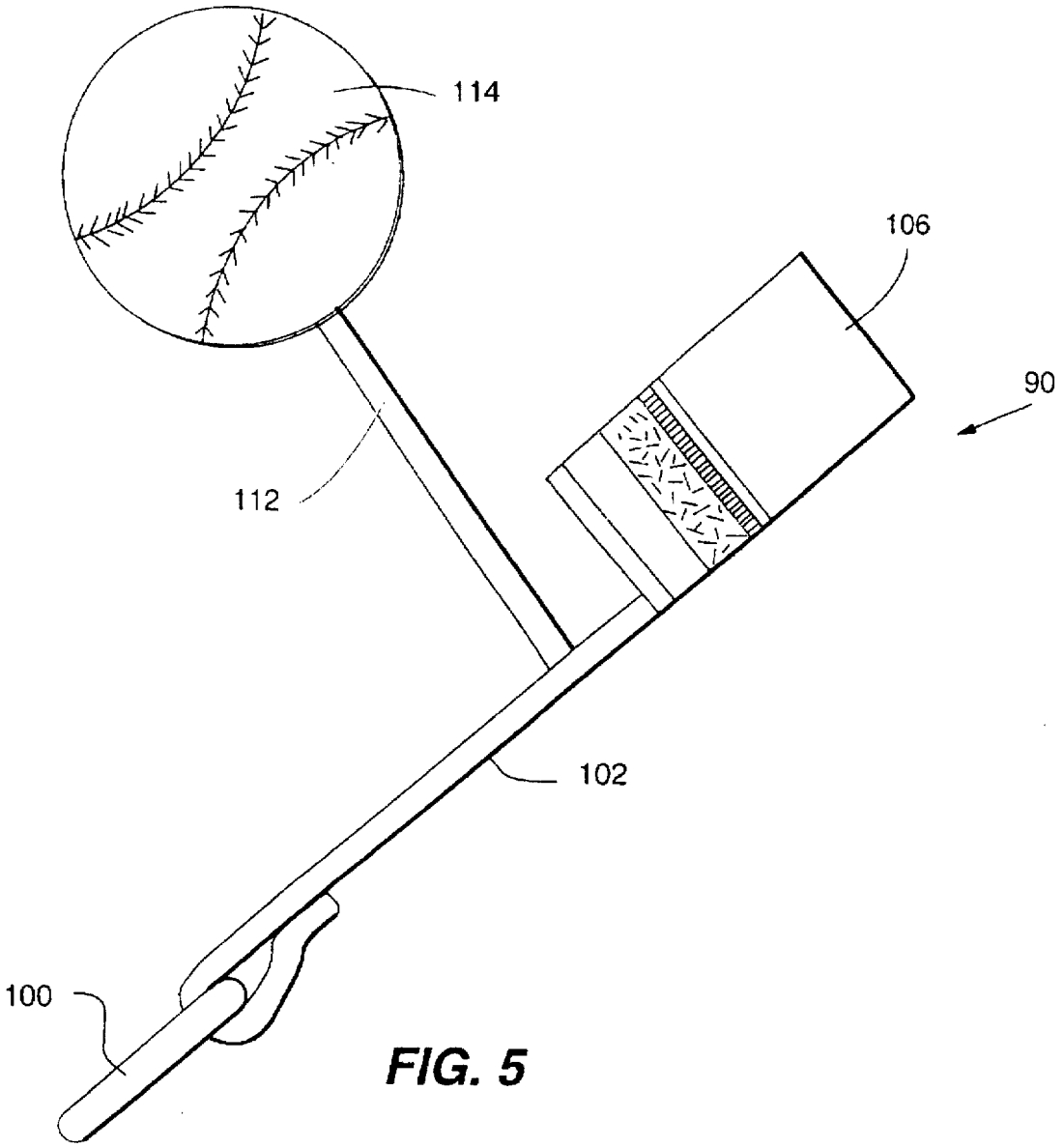
FIG. 5 is a side view of the wrist wrap of the present invention including a ball and cord apparatus.

As can be better understood with reference to FIG. 4, wrist wrap 90 may, in one embodiment, consist of a cordura strap 106 that is approximately 14 inches in length. The cordura strap 106 is neoprene lined for comfort. The neoprene liner 104 is approximately ¼ inch thick and approximately 6½ inches in length. Along the end 92 of strap 106 is a VELCRO brand hook and loop lining 96 which engages with VELCRO brand hook and loop lining 98 located along the middle of the strap. Metal ring 108 is used for tightening the strap 106 and bringing linings 98 and 96 into contact with one another. Stitched to the cordura strap 106 is a single piece of cordura 102, approximately 8 inches in length and 1½ inches wide. At the end of the single piece of cordura 102 is a metal half moon shaped ring 100. Metal half moon shaped ring 100 is required for attaching the wrist wrap 90 to cable 64 of the exercise machine.

With reference to FIG. 4, it can be seen that a user places his or her wrist through the center of the wrist wrap 90, indicated generally by reference character 110, and tightens and fastens the hook and loop linings 98 and 96 of strap 106 around his or her wrist. The user then clasps cable 64 to the half moon shaped ring 100 located at the end of the single piece of cordura 102. Optionally, as can be seen with reference to FIG. 5, a baseball 114 may be attached to the wrist wrap 90 by an elastic cord 112 to offer a realistic feel to the exercise.

As discussed earlier, weights 30 may be replaced in the machine of the invention by a computerized controlled resistance. Although not depicted in the drawings, it is readily understood by those skilled in the art that weights 30 may be replaced with a microprocessor based controller having appropriate power and ground connections as well as a data display and input unit coupled with appropriate data control lines.

In a preferred embodiment, the microprocessor includes a ROM memory containing the control program described with reference to FIGS. 6A–6C. The microprocessor would include a number of input and output ports connected to peripheral devices which may include a digital display and keyboard.

Operation of the controller software is explained in greater detail with reference to the program flow charts of FIGS. 6A–6C.

Figure 6A:
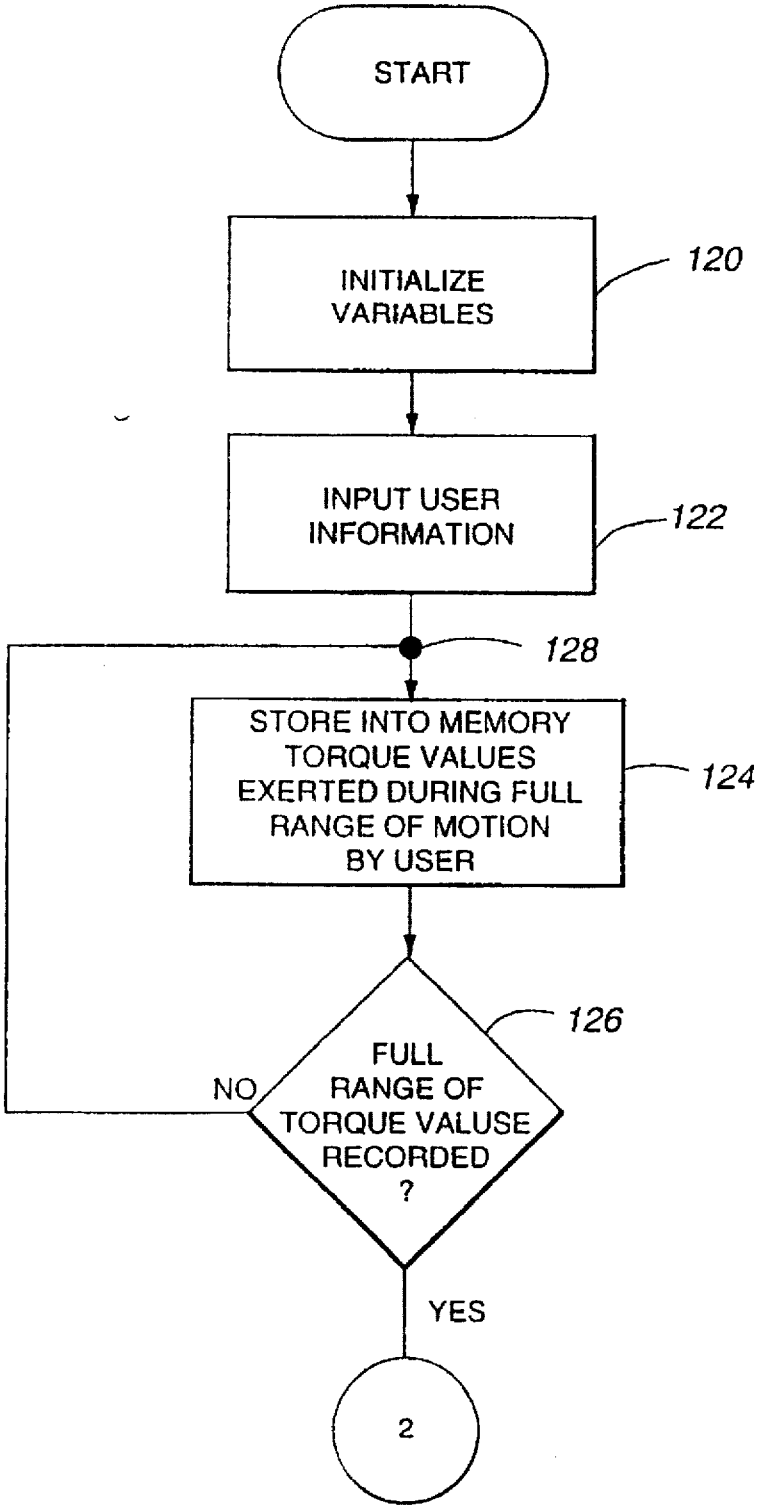
FIGS. 6A through 6C are flow charts for the operational software for the computer generated resistance of the invention.
Figure 6B:
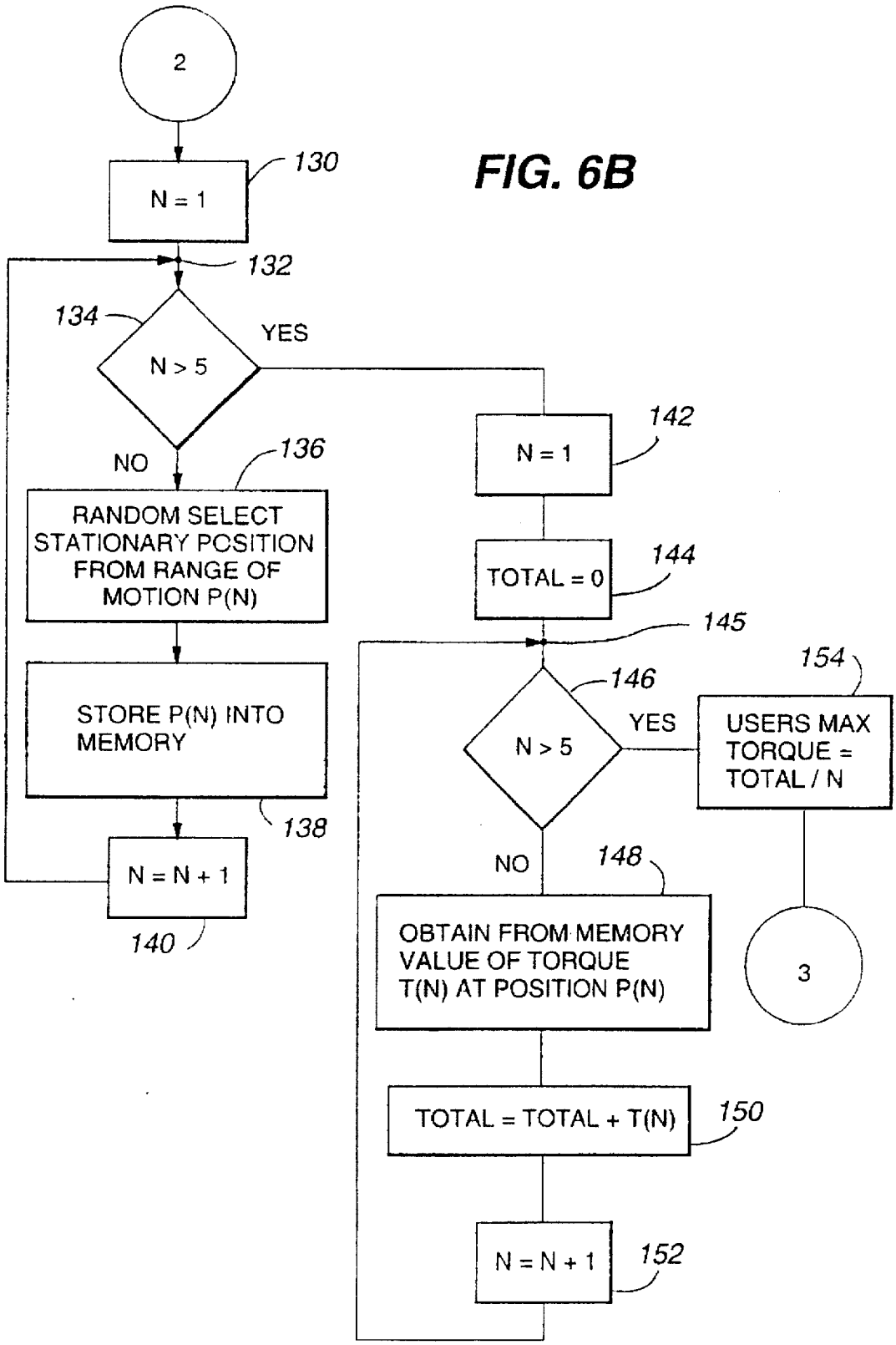

Upon initial power up, the program starts as indicated in FIG. 6A with segment 120 which initializes the memory and variables used in the operation of the program. At step 122, the user enters his or her individual information into the computer through either a keyboard or touch screen display. Since a full range of the user's motion must be recorded and stored into memory before proper exercise protocol can be performed, at step 124 the system prompts the user to complete a full phase of concentric contraction, where the arm is extended in front of the body and taken back above the head, and a full phase of eccentric contraction, where the arm is taken from above the head back to extension in front of the body.

Through an internal checking routine, at step 126 the program ensures that it has received a full range of values to create a proper exercise protocol. If, at step 126, a full range of torque values have not been recorded for a user through a phase of motion, the program loops back up to junction point 128 where it then proceeds back to step 124 in order to prompt the user to perform a full cycle of concentric and eccentric contractions.

If, at step 126, a full range of torque values have been recorded, the control program proceeds to routine 2, which is best described with reference to FIG. 6B.

At step 130 (FIG. 6B), the control program initializes its internal counter "N" to 1. The program proceeds to decision point 134 where it compares the internal counter "N" to a maximum value of five. It is readily understood that maximum value five may be increased and decreased accordingly, dependant upon how precise the sampling of user information should be.

At step 136, the program randomly selects a stationary portion from the range of motion initially performed by the user, and assigns it the value of P(N). P(N) is stored into memory at step 138, and the program proceeds to step 140 where it increases the value of "N" by one. The program then loops back to junction point 132 where it feeds back into decision block 134 and "N" is compared to five. If, at step 134, "N" is less than five, the program repeats the loop that was just described.

If, at step 134, the value of "N" has become greater than five, the program proceeds to step 142 where it resets the value of "N" to one. Next, the program continues to step 144 where the value of "TOTAL" is initialized to zero. The program then proceeds into the loop beginning at decision point 146, where, again, "N" is compared with the value five.

If, at step 146, "N" is not greater than five, the program proceeds to step 148 where the system obtains from memory the value of torque, T(N), exerted by the user at position P(N) from the values recorded in the initial range of motion recorded for the user.

The program now proceeds to step 150 where the value of total is increased by the value of T(N). Then, at step 152, the value of "N" is increased by 1, and the program loops back to junction point 145 where control transfers back into the loop just described.

If, at step 146, the value of "N" is now greater than five, the program proceeds to step 154 where it calculates the value of the maximum torque for the user. The maximum concentric torque for the user is equal to the total sum of torque ranges T(1) to T(N), divided by "N". The program continues to routine 3, depicted in FIG. 6C, where the actual exercise resistances are generated.

Figure 6C:
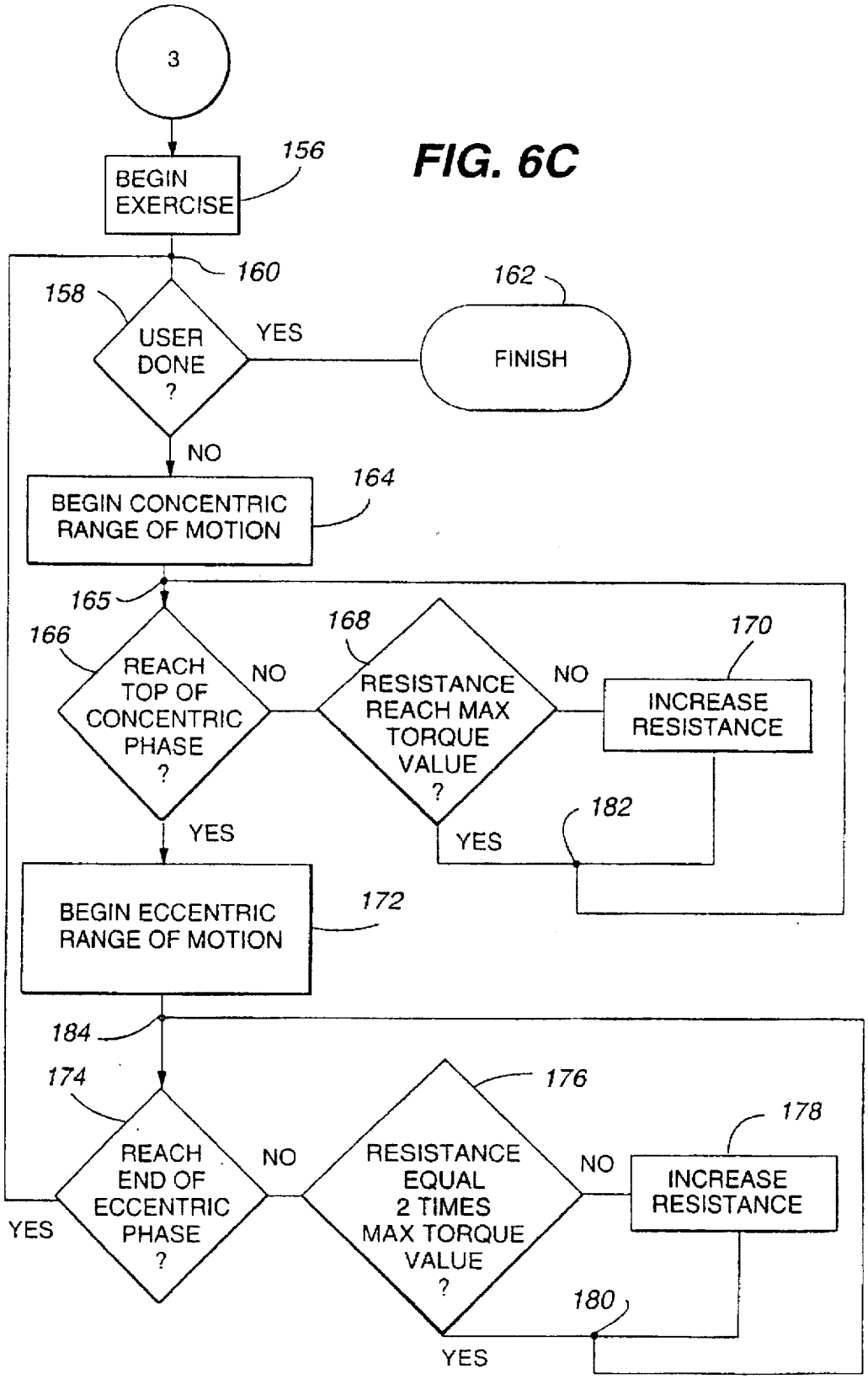

As seen with reference to FIG. 6C, the user begins exercising at step 156. If the user is not done at step 158, the program proceeds to step 164 where the user begins his or her concentric range of motion. If, at step 166, the user has not reached the top of his or her concentric range of motion, the program proceeds to step 168 where it determines whether the user has reached the maximum concentric torque value calculated for that user. If, at step 168, the user has not reached his or her maximum concentric torque value, the program proceeds to step 170 and increases the resistance by a predetermined increment. If, at step 168, the user has reached his or her maximum concentric torque value, the system drops to junction point 182, then loops back up to junction point 165 where it feeds back into decision block 166 in order to determine if the user has reached the top of the concentric phase.

If, at step 166, the user has reached the top of concentric phase contraction, the program proceeds to step 172 where it allows the user to begin the eccentric range of motion. At step 174, if the user has not reached the end of the eccentric phase contraction, the program proceeds to step 176 where it compares the current resistance to a value equal to two times the maximum concentric torque value (although the multiplier used in this example is "2", it should be readily appreciated that any other appropriate multiplier could be used—appropriate multipliers would range from 1.2 to 3.0 or higher). If the resistance exerted has not reached two times the maximum concentric torque value calculated for that user at step 176, the program proceeds to step 178 where it increases the resistance by some predetermined amount. The program continues to junction point 180, and then loops back to junction point 184 where it feeds back into the loop that determines if the user has reached the end of their eccentric phase.

If, at step 174, the user has reached the end of his or her eccentric phase, effectively completing a single cycle of motion, the program loops back to junction point 160 so that the program may check if the user is done exercising at step 158. If the user is done exercising at step 158, the program proceeds to step 162 where the execution is finished.

What is claimed is:

1. A throwing motion exercise machine, comprising:

(a) a cable having gripping means for gripping the cable near an endpoint of the cable, the gripping means being adapted for use by one arm of an exerciser, (b) a graduated weight resistance operatively connected to the cable, (c) a seat for receiving the exerciser within reach of the gripping means, (d) a brace in front of the seat, the brace being oriented to brace the exerciser's chest, so that the exerciser, when seated on the seat and engaging the gripping means with one arm may simulate a throwing motion by drawing the cable endpoint from a first position in front of the exerciser to a second position diagonally upwards of the first position, the first position corresponding to a release point of a throwing motion, the second position corresponding to a starting point of a throwing motion, (e) a vertical support frame facing the seat, the vertical support frame having a right corner lower than the seat and a left side corner lower than the seat, and a pulley near at least one of said corners, wherein the cable passes around the pulley, a first end of the cable leading away from the pulley towards the gripping means, and wherein the gripping means includes a ball adapted to be grasped by the exerciser while the exerciser simulates a throwing motion of the ball.

2. A machine for exercising the rotator cuff, comprising:

(a) a frame having a right side and a left side, the right side having an upper right side end and a lower right side end, the left side having an upper left side end and a lower left side end;

(b) a graduated weight resistance supported on the frame for movement along a working stroke from a rest position against a gravitational force to a displaced position;

(c) a body support member spaced apart from the frame and including a seat for supporting a user in a seated position facing the frame;

(d) a carrier passing through the graduated weight resistance;

(e) a center pulley mounted to said carrier;

(f) an upper right pulley mounted proximate to the upper right side end of the frame, and a lower right pulley mounted proximate to the lower right side end of the right side of the frame;

(g) an upper left pulley mounted proximate to the upper left side end of the frame, and a lower left pulley mounted proximate to the lower left side end of the left side of the frame; and (h) a cable having a left cable end and a right cable end, the cable being threaded from the left cable end around the lower left pulley, the upper left pulley, the center pulley, the upper right pulley, and the lower right pulley, (i) gripping means for gripping the cable near at least one of the left cable end and the right cable end, the gripping means being adapted for use by one arm of the user so that the user, when seated on the seat and engaging the gripping means with one arm may simulate a throwing motion by drawing the cable end from a first position in front of the user to a second position diagonally upwards of the first position, the first position corresponding to a release point of a throwing motion, the second position corresponding to a starting point of a throwing motion, wherein said body support member includes handles mounted in front of the seat and adjustable vertically.

3. A machine for exercising the rotator cuff, comprising:

(a) a frame having a right side and a left side, the right side having an upper right side end and a lower right side end, the left side having an upper left side end and a lower left side end;

(b) a graduated weight resistance supported on the frame for movement along a working stroke from a rest position against a gravitational force to a displaced position;

(c) a body support member spaced apart from the frame and including a seat for supporting a user in a seated position facing the frame;

(d) a carrier passing through the graduated weight resistance;

(e) a center pulley mounted to said carrier;

(f) an upper right pulley mounted proximate to the upper right side end of the frame, and a lower right pulley mounted proximate to the lower right side end of the right side of the frame;

(g) an upper left pulley mounted proximate to the upper left side end of the frame, and a lower left pulley mounted proximate to the lower left side end of the left side of the frame; and (h) a cable having a left cable end and a right cable end, the cable being threaded from the left cable end around the lower left pulley, the upper left pulley, the center pulley, the upper right pulley, and the lower right pulley, (i) gripping means for gripping the cable near at least one of the left cable end and the right cable end, the gripping means being adapted for use by one arm of the user so that the user, when seated on the seat and engaging the gripping means with one arm may simulate a throwing motion by drawing the cable end from a first position in front of the user to a second position diagonally upwards of the first position, the first position corresponding to a release point of a throwing motion, the second position corresponding to a starting point of a throwing motion wherein the graduated weight resistance includes a microprocessor controlled means for selectively applying a variable weight resistance responsive to a torque exerted by the exerciser; and said body support member includes handles mounted in front of the seat and adjustable vertically.

* * * * *